US009737773B2

(12) United States Patent
Ciasullo

(10) Patent No.: US 9,737,773 B2
(45) Date of Patent: Aug. 22, 2017

(54) ADJUSTABLE GOLF TEE

(71) Applicant: Creative Golf Innovations LLC, South Plainfields, NJ (US)

(72) Inventor: Mark Ciasullo, Butler, NJ (US)

( * ) Notice: Subject to any disclaimer, the term of this patent is extended or adjusted under 35 U.S.C. 154(b) by 0 days.

(21) Appl. No.: 15/066,897

(22) Filed: Mar. 10, 2016

(65) Prior Publication Data

US 2017/0173423 A1 Jun. 22, 2017

Related U.S. Application Data

(60) Provisional application No. 62/268,376, filed on Dec. 16, 2015.

(51) Int. Cl.
*A63B 57/15* (2015.01)

(52) U.S. Cl.
CPC ..... *A63B 57/15* (2015.10)

(58) Field of Classification Search
CPC ..... A63B 57/10–57/19; A63B 69/0075
USPC ..... D21/717, 718
See application file for complete search history.

(56) References Cited

U.S. PATENT DOCUMENTS 1,959,347 A * 5/1934 Czichos ..... A63B 57/10 473/401
2,079,387 A * 5/1937 Sickmiller ..... A63B 57/10 248/161
2,693,358 A * 11/1954 Dawson, Jr. ..... A63B 57/10 248/157
3,406,977 A * 10/1968 Voelkerding ..... A63B 57/10 473/257
3,690,676 A * 9/1972 Costa ..... A63B 57/10 473/398
3,858,878 A * 1/1975 Tassone ..... A63B 69/0075 473/398
3,883,138 A * 5/1975 Chorey ..... A63B 69/0075 473/417
4,136,869 A * 1/1979 Tassone ..... A63B 69/0075 473/417
5,156,403 A 10/1992 Martino
5,766,100 A * 6/1998 Dilmore ..... A63B 57/10 473/396
6,083,121 A * 7/2000 Hovey ..... A63B 69/3661 473/387
6,086,486 A 7/2000 Murphy et al.
6,328,663 B1 12/2001 Lipstock
6,893,363 B1 * 5/2005 Chen ..... A63B 69/0002 473/417
7,086,972 B2 8/2006 Bainbridge et al.
7,094,163 B2 8/2006 Lu et al.
(Continued)

OTHER PUBLICATIONS

Adjustable Practice Mat Tee Combo Source: http://www.realfeelgolfmats.com/golf-accessories/adjustable/ Date Accessed: Mar. 10, 2016.

(Continued)

*Primary Examiner* — Steven Wong

(57) ABSTRACT

A telescoping golf ball tee with an internal locking mechanism is provided. The internal locking mechanism permits the golf ball tee neck to adjust to a desired height while still supporting the weight of a golf ball. Upon impact, a bowl-like member at the base of the golf ball tee neck is forced into a cavity in the golf ball tee base which, in turn, applies force to the golf ball tee neck which prevents the neck from escaping the base.

5 Claims, 7 Drawing Sheets

(56) References Cited

U.S. PATENT DOCUMENTS

| | | | | |
|---|---|---|---|---|
| 8,979,681 | B1 * | 3/2015 | Murphy | A63B 69/0075 473/417 |
| 2004/0204268 | A1 * | 10/2004 | Hsien | A63B 57/10 473/396 |
| 2005/0143195 | A1 * | 6/2005 | Syu | A63B 57/10 473/396 |
| 2005/0245330 | A1 | 11/2005 | Gustine | |
| 2006/0035728 | A1 * | 2/2006 | Chang | A63B 57/10 473/387 |
| 2007/0149324 | A1 * | 6/2007 | Tsai | A63B 57/10 473/387 |
| 2007/0249433 | A1 * | 10/2007 | DeSmit | A63B 57/10 473/397 |
| 2007/0298910 | A1 * | 12/2007 | Potempa | A63B 57/10 473/401 |
| 2008/0102988 | A1 | 5/2008 | Sagadevan | |
| 2009/0137345 | A1 * | 5/2009 | Sagadevan | A63B 57/10 473/396 |
| 2009/0258732 | A1 * | 10/2009 | Lee | A63B 57/10 473/398 |
| 2009/0325726 | A1 | 12/2009 | Humphrey | |
| 2010/0173730 | A1 | 7/2010 | Iacono et al. | |
| 2012/0028735 | A1 | 2/2012 | Klein | |
| 2012/0214616 | A1 | 8/2012 | Lipstock et al. | |
| 2013/0337944 | A1 * | 12/2013 | Lee | A63B 57/00 473/396 |
| 2016/0271473 | A1 * | 9/2016 | Fitzpatrick | A63B 69/0075 |

OTHER PUBLICATIONS

Adjustable Height Groove Rt Tee Source: http://globalgolfproducts.spiffystores.com/products/adjustable-height-groove-rt-tee Date Accessed: Mar. 10, 2016.

Just Rite Golf Tee Co. http://justritegolftee.com/index.htm Date Accessed: Mar. 10, 2016.

Twisttee http://www.twistteegolf.com/ Date Accessed: Mar. 10, 2016.

* cited by examiner

ADJUSTABLE GOLF TEE

CROSS REFERENCE TO RELATED APPLICATION(S)

This application claims the benefit of U.S. Provisional Application No. 62/268,376, filed on Dec. 16, 2015.

FIELD OF THE INVENTION

The present invention relates in general to golf accessories and, more specifically, to a reusable, telescoping golf tee used in concert with a driving range practice mat.

BACKGROUND

It is common knowledge to anyone who has practiced hitting golf balls on a driving range that finding the appropriate height tee is at best difficult. Driving range tees are used when hitting virtually any club in a golfer's bag. Some, such as short irons, require a very short tee height while others, such as a fairway wood or driver, require elevated tee heights to accommodate the deeper faces of these clubs.

Typically, a driving range will provide tees having multiple lengths for patrons to use during practice. The range may have to provide as many as five to six different, individual tees to accommodate their patrons. Often, however, driving ranges may provide fewer choices which will limit the golfer. Golfers will also be required to lift the range mat to manually substitute one fixed-length tee for another fixed-length tee if they desire to use a different club. This process takes time, can be a dirty process if the mat is wet or muddy, and it prevents a golfer from changing tee height for each shot, should they desire to do so, thereby limiting the way a golfer practices.

A need, therefore, exists in the art to provide a golf tee that can be adjusted without needing to replace one tee for another. A further need exists in the art for an adjustable golf tee that can be used repeatedly without being damaged by successive strikes with a golf club.

SUMMARY OF THE INVENTION

According to the present invention, the foregoing and other objects and advantages are obtained by an adjustable length golf tee assembly, comprising an annular shaft member with a longitudinal interior cavity; the shaft member having an integrally molded annular base at a first end; the shaft member having an internal annular concavity at a second end with an opening at the second end; an annular neck member telescopically coupled to the interior cavity of the shaft member through the opening at the second end of the shaft member; the neck member having a first end protruding outside the internal cavity of the shaft member; the first end of the neck member further comprising a concave appendage for receiving a golf ball thereon; the neck member having a second end disposed within the internal cavity of the shaft member; and the second end of the neck member further comprising a bowl shaped appendage adapted to fit within the annular concavity at the second end of the shaft member.

According to another aspect of the invention, the neck member telescopically extends coaxially within the interior cavity of the shaft member where the maximum extended distance between the first end of the shaft member and the first end of the neck member is achieved when the bowl shaped appendage is telescopically slid into a mated configuration with the annular concavity at the second end of the shaft member.

According to another aspect of the invention, the shaft member, the neck member, the bowl shaped appendage and the internal annular concavity is constructed from a material selected from a group consisting of rubber, polyurethane or a synthetic composite.

According to another aspect of the invention, a plurality of raised surfaces are disposed along the surface of the neck member and frictionally mate with the interior surface of the longitudinal interior cavity.

BRIEF DESCRIPTION OF THE DRAWINGS

The invention will become more readily apparent from the following description of preferred embodiments thereof shown, by way of example only, in the accompanying drawings wherein.

DETAILED DESCRIPTION OF THE INVENTION

Figure 1:
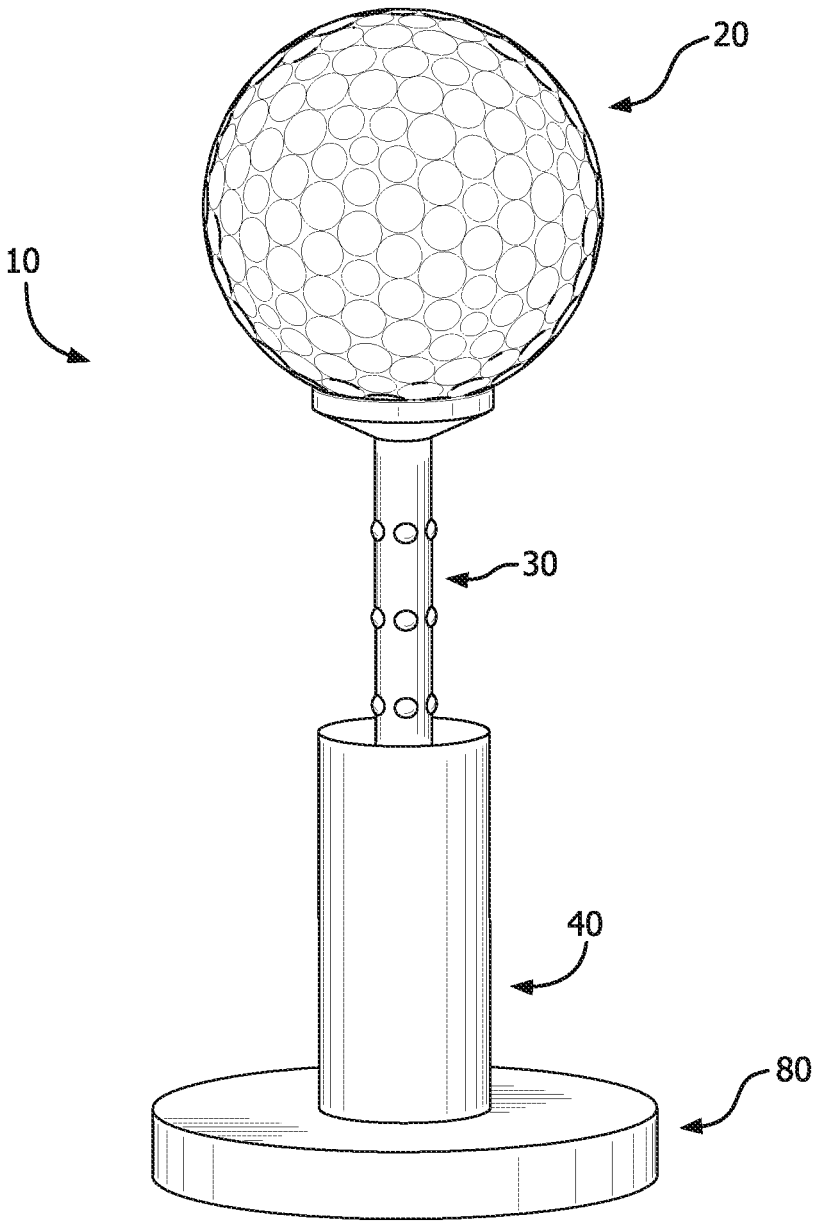
FIG. 1 is a perspective view of a golf tee according to one aspect of the invention.

FIG. 1 illustrates an adjustable golf tee of the instant invention, generally identified by reference numeral 10. The adjustable golf tee 10 is depicted in FIG. 1 with a golf ball 20 resting on top of a concave (not depicted) surface on adjustable neck 30. Adjustable neck 30 is capable of being adjusted to rest at variable elevations. Adjustable neck 30 is telescopically joined together with neck 30 in an interlocking relationship to form a unitary device that is not intended to be separated during use. Base 40 is attached or, in a preferred embodiment, integrally molded into the annularly shaped mounting plate 80. Adjustable neck 30 can telescope to different elevations by applying sufficient force on the adjustable neck 30 to overcome the friction fitting that holds adjustable neck 30 in a fixed elevation relative to base 40. In another embodiment of the invention, friction fitting or any other commonly used technique known to those having ordinary skill in the art can be employed to maintain the height of the neck 30 when it is holding the weight of golf ball 20.

Figure 2:
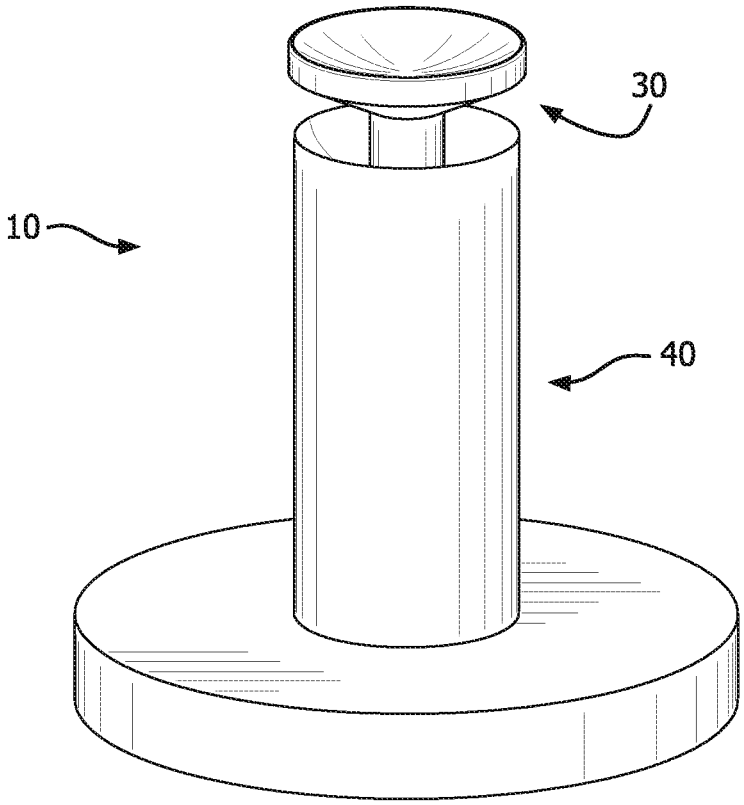
FIG. 2 is a perspective view of a golf tee according to one aspect of the invention.

FIG. 2 depicts golf tee 10 in another orientation with neck 30 collapsed into the internal volume of base 40. By adjusting the elevation of adjustable neck 30 relative to base 40, a golfer can set a tee height of his choice, at will, on any or every shot, without having to replace the golf tee 10 in an attempt to achieve a desired height for their club selection.

In the preferred embodiment, golf tee 10 is made from flexible rubber compound, polyurethane or a synthetic composite that is tolerant to a range of temperatures without a loss in rigidity to support a golf ball and maintain its structure, yet not so rigid as to impede the flexibility of the compounds for the purposes herein further described. Advantageously, the choice of such a compound provides the golfer with a desirable auditory feedback upon striking a golf ball with a golf club that cannot be achieved when harder, more brittle materials are used. Furthermore, harder, more brittle materials are subject to breakage whereas the preferred use of a rubber compound can maintain its structure after one or more uses.

Figure 3:
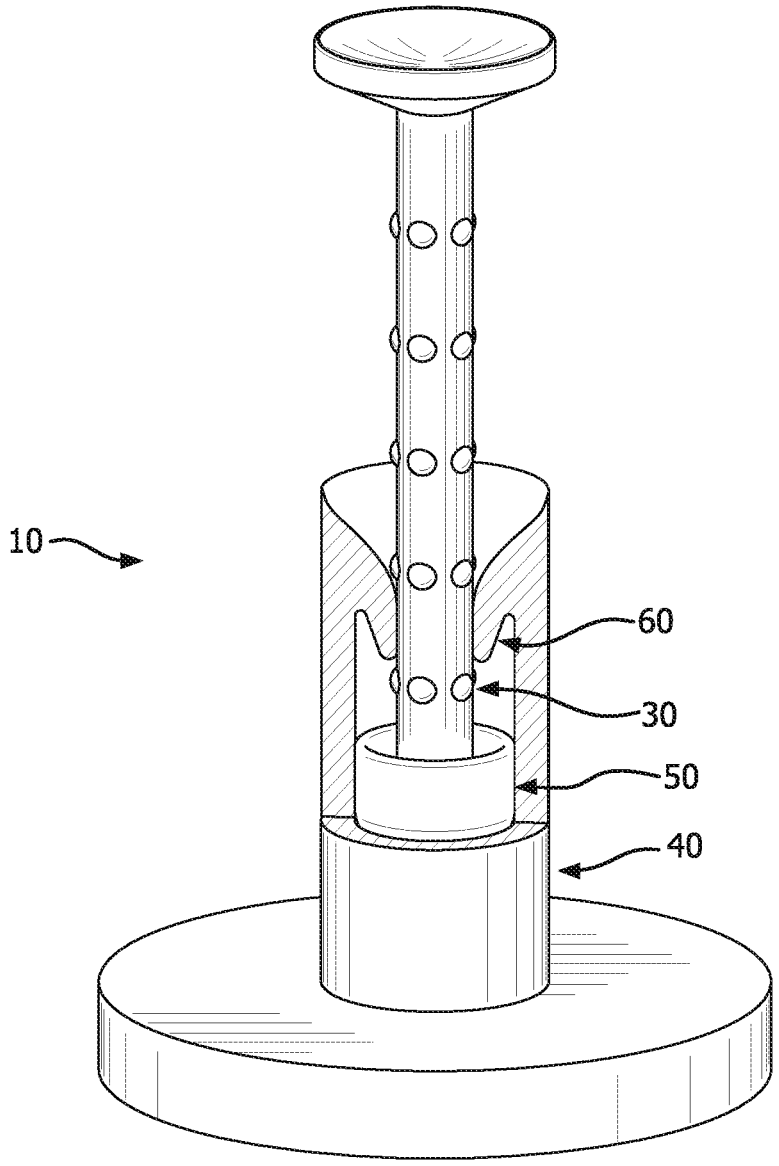
FIG. 3 is a perspective view of a partial cross section of a golf tee according to one aspect of the invention.
Figure 4:
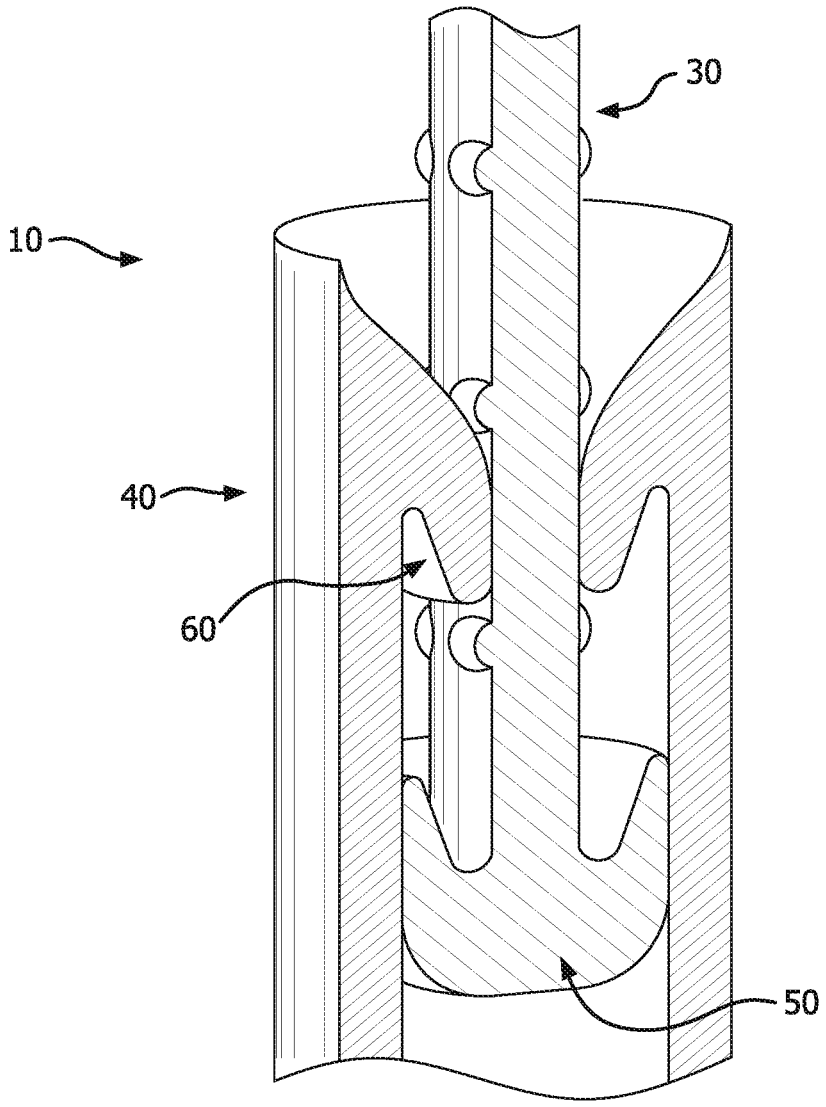
FIG. 4 is a perspective view of a cross section of a golf tee according to one aspect of the invention.

Adjustable neck 30 is designed to remain attached to base 40 during use as a result of a novel locking design. FIG. 3 depicts a partial cross-section of base 40. Adjustable neck 30 has a cup 50 at the internal end of adjustable neck 30. Cup 50 is depicted in FIG. 3 as a bowl-like structure. In other embodiments (not depicted), this bowl-like structure could take the form of a cube, pyramid or other structure known to those having ordinary skill in the art that would permit mating with a corresponding channel in the manner herein described. As depicted in FIG. 3, adjustable neck 30 is in a lower elevation relative to the maximum possible elevation. Channel 60 is depicted near the top of base 40. FIG. 4 also depicts a partial cross-section of base 40. Adjustable neck 30 has a cup 50 at the internal end of adjustable neck 30. As depicted in FIG. 4, adjustable neck 30 is in a lower elevation relative to the maximum possible elevation. Channel 60 is depicted near the top of base 40. Channel 60 as shown in FIGS. 3 through 7 is the longitudinal interior cavity of the annular shaft member (that is described in the Summary of the Invention section of this Specification) having the mating contours described herein.

Figure 5:
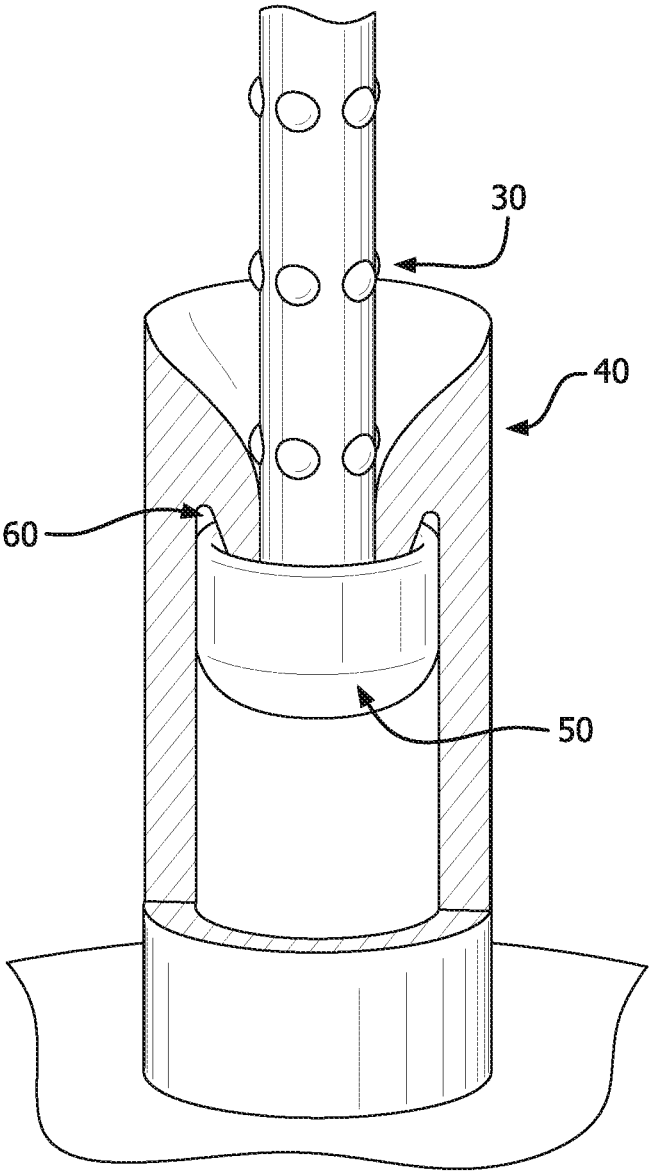
FIG. 5 is a perspective view of a partial cross section of a golf tee according to one aspect of the invention.
Figure 6:
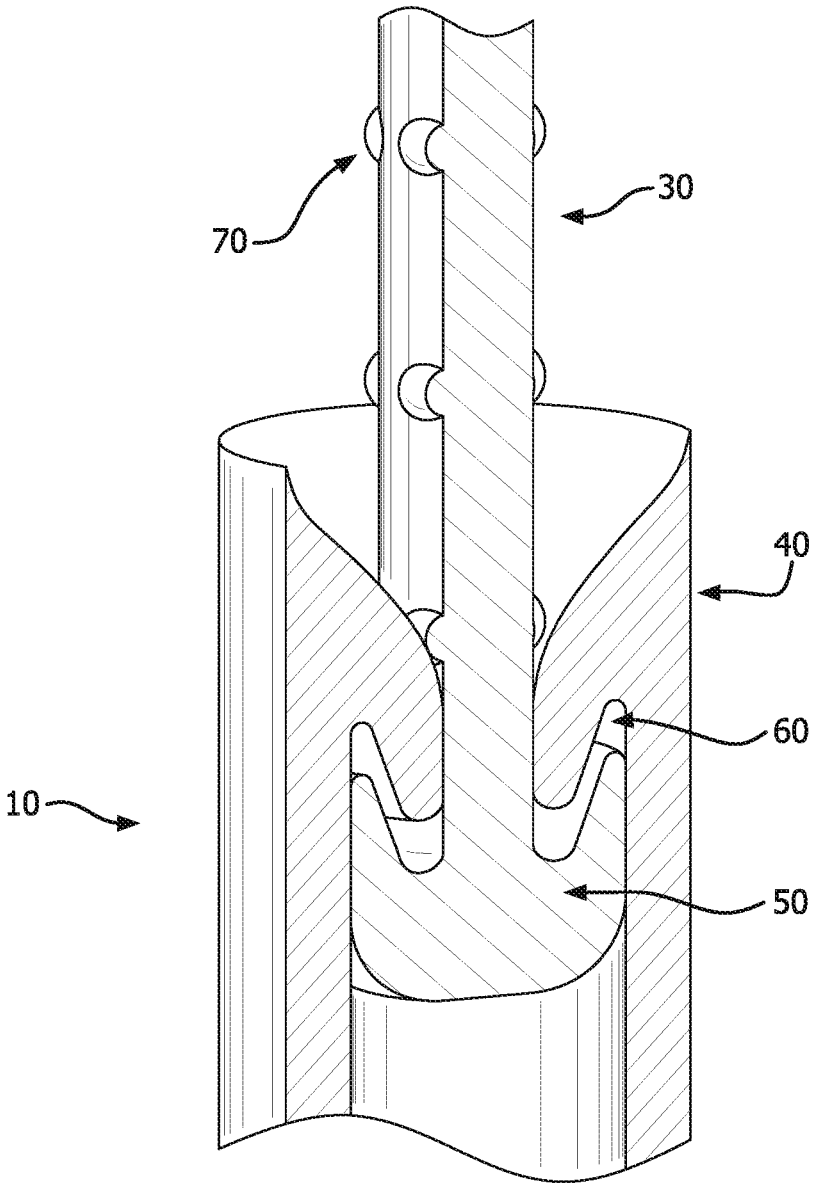
FIG. 6 is a perspective view of a cross section of a golf tee according to one aspect of the invention.

FIG. 5 depicts a partial cross-section of base 40. In this orientation, adjustable neck 30 is raised to its maximum elevation. Cup 50 is mated with the contours of channel 60, thereby causing adjustable neck 30 to be locked into base 40. FIG. 6 also depicts a partial cross-section of base 40. In this orientation, adjustable neck 30 is raised to its maximum elevation. Cup 50 is mated with the contours of channel 60, thereby causing adjustable neck 30 to be locked into base 40.

Figure 7:
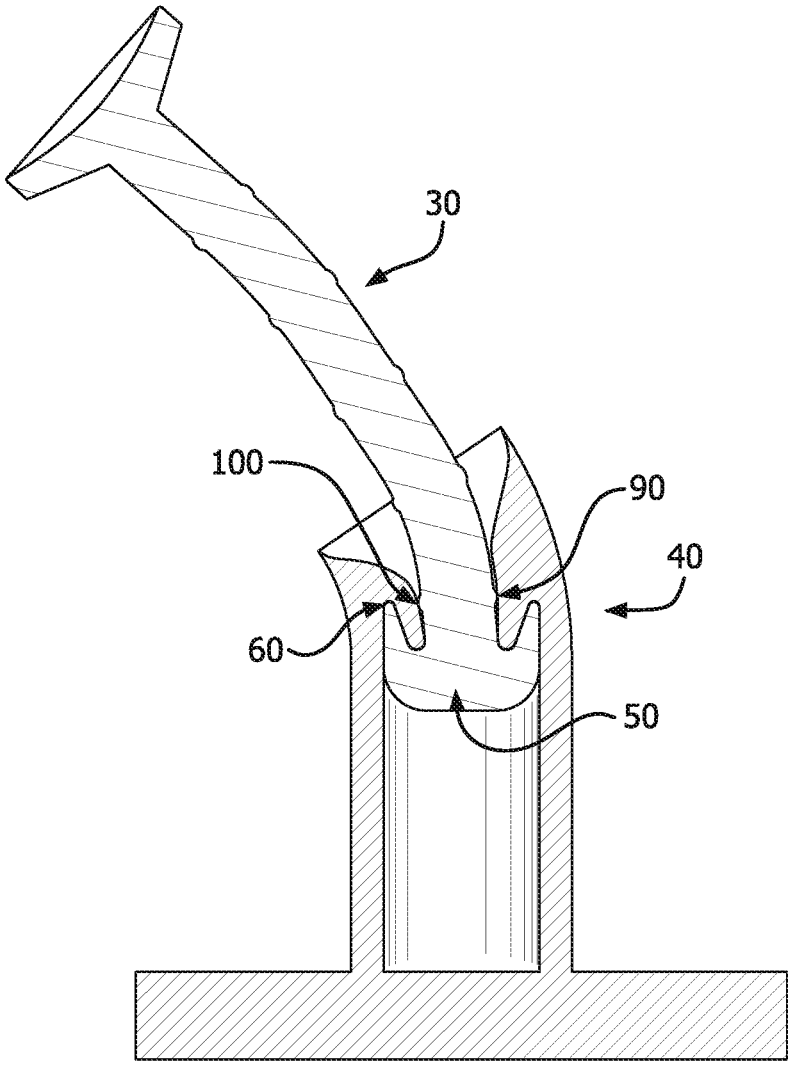
FIG. 7 is a perspective view of a cross section of a golf tee according to one aspect of the invention.

In use, the force of a golf club (not depicted) striking golf ball 20 will ordinarily cause the adjustable neck 30 to extend to its maximum elevation, but by mating cup 50 with channel 60, the adjustable neck 30 remains at all times within the internal volume of base 40. As shown in FIG. 7, during a golf club impact, the inner volume of the channel 60 is filled with a corresponding portion of mating cup 50. It is believed that during impact, the mating cup 50 causes force to be exerted generally on the areas identified as point 90 and point 100. This force is believed to pinch the portion of neck 30 that makes contact with the areas surrounding point 90 and point 100. It is believed that this effectively closes down the only point of egress for adjustable neck 30 from base 40. This process is believed to occur during the point of maximum stress from an impact, and at the most critical and only point of possible separation, effectively shutting down the escape point and preventing separation. In this manner, neck 30 remains attached to base 40 and a user may simply re-adjust the telescoping adjustable neck 30 to a desired elevation in-between golf shots.

In a preferred embodiment, raised bumps 70 are depicted on adjustable neck 30 in FIG. 6. Bumps 70 are used to facilitate a users' ability to maintain the desired pre-determined height while supporting the weight of golf ball 20 (as depicted in FIG. 1). In a preferred embodiment, a golf mat (not depicted) having a hole with a diameter wide enough to accommodate the insertion of adjustable neck 30 and base 40 is rested on top of mounting plate 80 (as shown in FIG. 1). Mounting plate 80 has a larger diameter than the golf mat hole, so the force of a club strike will not separate the golf tee 10 from the golf mat. As a result, when the tee of the instant invention is used with a telescoping adjustable neck 30, it is unnecessary to remove the golf tee from the golf mat after it is installed.

What is claimed is:

1. An adjustable length tee assembly comprising:

an annular shaft member with a longitudinal interior cavity;

the shaft member having an integrally molded annular base at a first end;

the shaft member having an opening at the second end;

the longitudinal interior cavity of the shaft member having mating contours that define a channel;

an annular neck member telescopically coupled to the interior cavity of the shaft member through the opening at the second end of the shaft member;

the neck member having a first end protruding outside the interior cavity of the shaft member;

the first end of the neck member comprising a concave appendage for receiving a ball thereon;

the neck member having a second end disposed within the interior cavity of the shaft member; and the second end of the neck member comprising a bowl-like structure that defines a recess adapted to mate with the channel defined by the mating contours.

2. The adjustable length tee assembly of claim 1 wherein the neck member telescopically extends coaxially within the interior cavity of the shaft member whereby the maximum elevation of the first end of the neck member is achieved when the recess defined by the bowl-like structure is telescopically slid into and mated with the channel defined by the mating contours and locked at such maximum elevation.

3. The adjustable length tee assembly of claim 1 wherein the shaft member and the neck member are constructed from a material selected from a group consisting of rubber, polyurethane, and a synthetic composite.

4. An adjustable length tee assembly consisting of:

a base having a longitudinal interior cavity having mating contours that define a channel disposed therein;

said base having an integrally molded annularly shaped mounting plate at a first end;

said base having an opening at a second end;

a neck member disposed telescopically within said longitudinal interior cavity of said base adapted to mate frictionally with the surface of said longitudinal interior cavity;

said neck member having a first end protruding from said longitudinal interior cavity of said base that is a concave appendage for receiving a ball thereon; and said neck member having a second end within said longitudinal interior cavity that is a bowl-like structure that defines a recess adapted to mate with the channel defined by said mating contours;

whereby the maximum elevation of said first end of said neck member is achieved when the recess defined by said bowl-like structure is telescopically slid into and mated with said channel defined by said mating contours and locked at said maximum elevation.

5. The adjustable length tee assembly of claim 4 wherein said base and said neck member are constructed from a material selected from a group consisting of rubber, polyurethane, and a synthetic composite.

* * * * *